US010164363B2

(12) United States Patent
Enomoto et al.

(10) Patent No.: US 10,164,363 B2
(45) Date of Patent: Dec. 25, 2018

(54) DOUBLE-SIDED CARD EDGE CONNECTOR

(71) Applicants: NIPPON TANSHI CO., LTD., Oiso-Machi, Naka-gun (JP); SUBARU CORPORATION, Shibuya-ku (JP); MITSUBISHI ELECTRIC CORPORATION, Chiyoda-ku (JP)

(72) Inventors: Shinya Enomoto, Oiso-Machi (JP); Osamu Nishimura, Oiso-Machi (JP); Masaru Fujino, Oiso-Machi (JP); Nobuhiko Ochiai, Oiso-Machi (JP); Yuya Inoue, Shibuya-ku (JP); Makoto Iijima, Shibuya-ku (JP); Koichi Inoue, Shibuya-ku (JP); Yasuaki Ito, Shibuya-ku (JP); Hiroyoshi Nishizaki, Chiyoda-ku (JP); Fumiaki Arimai, Chiyoda-ku (JP)

(73) Assignees: NIPPON TANSHI CO., LTD., Kanagawa (JP); SUBARU CORPORATION, Tokyo (JP); MITSUBISHI ELECTRIC CORPORATION, Tokyo (JP)

( * ) Notice: Subject to any disclaimer, the term of this patent is extended or adjusted under 35 U.S.C. 154(b) by 13 days.

(21) Appl. No.: 15/662,900

(22) Filed: Jul. 28, 2017

(65) Prior Publication Data

US 2018/0034177 A1 Feb. 1, 2018

(30) Foreign Application Priority Data

Jul. 29, 2016 (JP) ..... 2016-149459

(51) Int. Cl.

| | |
|---|---|
| ***H01R 12/00*** | (2006.01) |
| ***H01R 12/72*** | (2011.01) |
| ***H01R 13/40*** | (2006.01) |
| ***H01R 12/75*** | (2011.01) |
| ***H01R 13/424*** | (2006.01) |

(52) U.S. Cl.

CPC ..... *H01R 12/721* (2013.01); *H01R 12/75* (2013.01); *H01R 13/40* (2013.01); *H01R 13/424* (2013.01)

(58) Field of Classification Search

CPC ..... H01R 12/721; H01R 12/82; H01R 13/40
USPC ..... 439/60
See application file for complete search history.

(56) References Cited

U.S. PATENT DOCUMENTS

| | | | | |
|---|---|---|---|---|
| 3,399,377 A * | 8/1968 | Warzecka | ..... | H01R 12/721 439/634 |
| 3,646,504 A * | 2/1972 | Classon | ..... | H01R 12/721 439/188 |
| 8,715,009 B2 * | 5/2014 | Wu | ..... | H01R 12/82 439/637 |

FOREIGN PATENT DOCUMENTS

| | | |
|---|---|---|
| JP | H10-116663 | 5/1998 |

* cited by examiner

*Primary Examiner* — Jean F Duverne
(74) *Attorney, Agent, or Firm* — Cozen O'Connor

(57) ABSTRACT

To prevent an increase of the number of kinds of components required for offset arrangement, an increase in risk of assembly error and extra time and effort for parts management, in a connector including mutually facing terminal members with contacting portions being offset in the insertion direction. Mutually facing terminal members 20 are formed on components identical in shape. The mutually facing terminal members 20 are secured to a connector housing 12 while being offset in an insertion direction of a double-sided card edge 102 inserted into a receptacle compartment 14 of the connector housing 12.

9 Claims, 17 Drawing Sheets

DOUBLE-SIDED CARD EDGE CONNECTOR

BACKGROUND OF THE INVENTION

1. Field of the Invention

This invention relates to a double-sided card edge connector.

2. Description of the Related Art

A double-sided card edge connector (hereinafter abbreviated as a "connector") is known which has a connector housing including a receptacle compartment into which a card edge of a double-sided print board is inserted, and a terminal member including contact pieces having spring characteristics, the terminal member being attached to the connector housing such that the contact pieces are located on both sides of the receptacle compartment to face each other. The contact pieces include contacting portions coming into contact with the card edge located in a position inserted into the receptacle compartment, the mutually facing contacting portions of the terminal member are offset in an insertion direction of the card edge being inserted into the receptacle compartment (for example, Patent Literature 1).

In such a connector, because the mutually facing contacting portions of the terminal member are offset in the insertion direction, even if a high amount of protrusion of the contacting portions protruding into the receptacle compartment is set, the mutually facing contacting portions of the terminal member are kept from contact with each other. Therefore, this enables an increase of the amount of protrusion of the contacting portions protruding into the receptacle compartment as compared with the case of contacting portions that are directly opposite each other on both sides of the receptacle compartment. As a result, a terminal contact pressure based on the resilient deformation of the contact pieces is enabled to be set higher.

SUMMARY OF THE INVENTION

However, the conventional connectors need the use of two kinds of components (terminal members) having contacting portions formed in different positions in the insertion direction so that the contacting portions of the respective terminal members facing each other are offset in the insertion direction. This increases the number of kinds of necessary components, increases the risk of assembly error, and also requires extra time and effort for parts management.

A challenge addressed by the present invention is of providing a connector including mutually facing terminal members with contacting portions offset in the insertion direction without an increase in the number of kinds of components required for offset arrangement and without an increase in risk of assembly error as well as without extra time and effort for parts management.

A double-sided card edge connector according to the present invention comprises: a connector housing (12) including a receptacle compartment (14) into which a double-sided card edge (102) is inserted; and at least two terminal members (20) including contact pieces (26) having spring characteristics, the terminal members (26) being attached to the connector housing. The terminal members (20) are arranged to face each other with the contact pieces (26) being positioned on both sides of the receptacle compartment (14). The contact pieces (26) include contacting portions (32) making contact with the double-sided card edge (102) within the receptacle compartment (14). The terminal members (20) facing each other are formed of components identical in shape, and the terminal members (20) facing each other are secured to the connector housing (12) while being offset in an insertion direction of the double-sided card edge (102) inserted into the receptacle compartment (14).

With this configuration, because the mutually facing terminal members (20) are formed of components identical in shape, an increase of the number of kinds of required components including the terminal members (20) for offset arrangement may be prevented and the expenditure of extra time and effort for parts management may be not required. Further, because the terminal members (20) are the same components, the terminal members (20) may not be incorrectly assembled to the connector housing (12).

In the double-sided card edge connector according to the present invention, preferably, the terminal members (20) facing each other have locked portions (40) engaged with the connector housing (12), while the connector housing (12) has locking portions (18, 19) with which the locked portions (40) of the respective terminal members (20) are engaged to lock the terminal members (20), and the locking portions (18, 19) provided for the terminal members (20) facing each other are formed to be offset in the insertion direction of the double-sided card edge (102).

With this configuration, the terminal members (20) are formed of components identical in shape, so that there is no need to increase the number of kinds of the terminal members (20) to achieve the offset arrangement, preventing the parts management from an increase in time effort.

In an embodiment of the double-sided card edge connector according to the present invention, the contact pieces (26) of the respective terminal members (20) facing each other include portions overlapping each other when viewed in plane of projection intersecting at right angles to the insertion direction.

With this configuration, the amount of protrusion of the contacting portion (32) protruding into the receptacle compartment (14) can be further increased.

In an embodiment of the double-sided card edge connector according to the present invention, the terminal members (20) facing each other forms terminal pairs (A, B). The terminal pairs (A, B) are properly arranged and spaced at a predetermined pitch, and all the terminal members (20) are formed of components identical in shape.

With this configuration, because all of the terminal members (20) are formed of components identical in shape, an increase of the number of kinds of required components including the terminal members (20) for offset arrangement may be prevented and the expenditure of extra time and effort for parts management may be not required. Further, because the terminal members (20) are the same components, the terminal members (20) may not be incorrectly assembled to the connector housing (12)

In the double-sided card edge connector according to the present invention, preferably, the terminal pairs (A, B) are provided in even numbers, and the terminal pairs (A, B) include terminal pairs in each of which one of the terminal members (20) is offset forward of the other terminal member (20) in the insertion direction, and terminal pairs in each of which one of the terminal members (20) is offset rearward of the other terminal member (20) in the insertion direction, and the former terminal pairs and the latter terminal pairs are identical in number.

With this configuration, when the double-sided card edge (102) comes into contact with the contacting portions (32), turning moments acting on the double-sided card edge (102) are compensated. Thus, when the double-sided card edge (102) is inserted into the receptacle compartment (14), the double-sided card edge (102) can be inserted without tilting.

In an embodiment of the double-sided card edge connector according to the present invention, in a plurality of the terminal pairs (A, B), the terminal pairs (A) in each of which one of the terminal members (20) is offset forward of the other terminal member (20) in the insertion direction, and the terminal pairs (B) in each of which one of the terminal members (20) is offset rearward of the other in the insertion direction, either are arranged in alternate order or form a plurality of clusters and are arranged.

With this configuration, because the contacting portions (32) in the terminal pair (A, B) are offset, when the double-sided card edge (102) comes into contact with the contacting portions (32), turning moments acting on the double-sided card edge (102) are compensated. Thus, when the double-sided card edge (102) is inserted into the receptacle compartment 14, the double-sided card edge 102 can be inserted without tilting.

In the double-sided card edge connector according to the present invention, preferably, each of the terminal members (20) includes a terminal body (24) having a groove-shaped cross-section portion (22), and each of the contact pieces (26) includes a proximal end (26A) which is coupled to the terminal body (24), and a free end which is located within the groove-shaped cross-section portion (22) to be located in a position away from the receptacle compartment (14) in a free state. The contact piece (26) has the contacting portion (32) between the proximal end (26A) and the free end, the contacting portion (32) being located within the receptacle compartment (14) in the free state. The free end forms an electric contact (34) for a board terminal (104) provided on the double-sided card edge (102). Upon insertion of the double-sided card edge (102) into the receptacle compartment (14), when the contacting portion (32) is pressed by the double-sided card edge (102), the electric contact (34) undergoes displacement to enter the receptacle compartment (14) to be pressed against the board terminal (104).

With this configuration, the contact (34) can be prevented from being worn or damaged by making contact with the double-sided card edge (102), because the contact (34) makes no sliding contact with the double-sided card edge (102) until the contacting portion (32) is pressed by the double-sided card edge (102). Further, the contact (34) may be avoided from being contaminated by impurities such as oil and/or the like in the assembling process. Thus, an electrical conduction failure may be prevented from being caused by the depositing of impurities to the contact (34), resulting in ensuring satisfactory conductive connection established between the contact (34) and the board terminal (104) with a high degree of reliability.

The double-sided card edge connector according to the present invention, preferably, the contact piece (26) further has a pivotable support (38) provided between the contacting portion (32) and the electric contact (34) and pivotably supported by a supporting portion (36) provided in the terminal body (24).

With this configuration, a lever may be formed when the pivotable support (38) acts as a fulcrum, the contacting portion (32) acts as a point of effort and the contact (34) acts as a point of load. Upon pressing the contacting portion (32), under the lever operation, the operation of the contact (34) entering the receptacle compartment (14) is satisfactorily performed with repeatability.

With the double-sided card edge connector according to the present invention, the mutually facing terminal members are formed of components identical in shape and the mutually facing terminal members are secured to the connector housing while being offset in the insertion direction of the card edge. As a result, the offset arrangement of the contacting portions will not cause any need to increase the number of kinds of necessary components, any increase in risk of assembly error, and any need of extra time and effort for parts management.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

An embodiment of a double-side card edge connector in accordance with the present invention will now be described with reference to FIG. 1 to FIG. 7.

Figure 1:
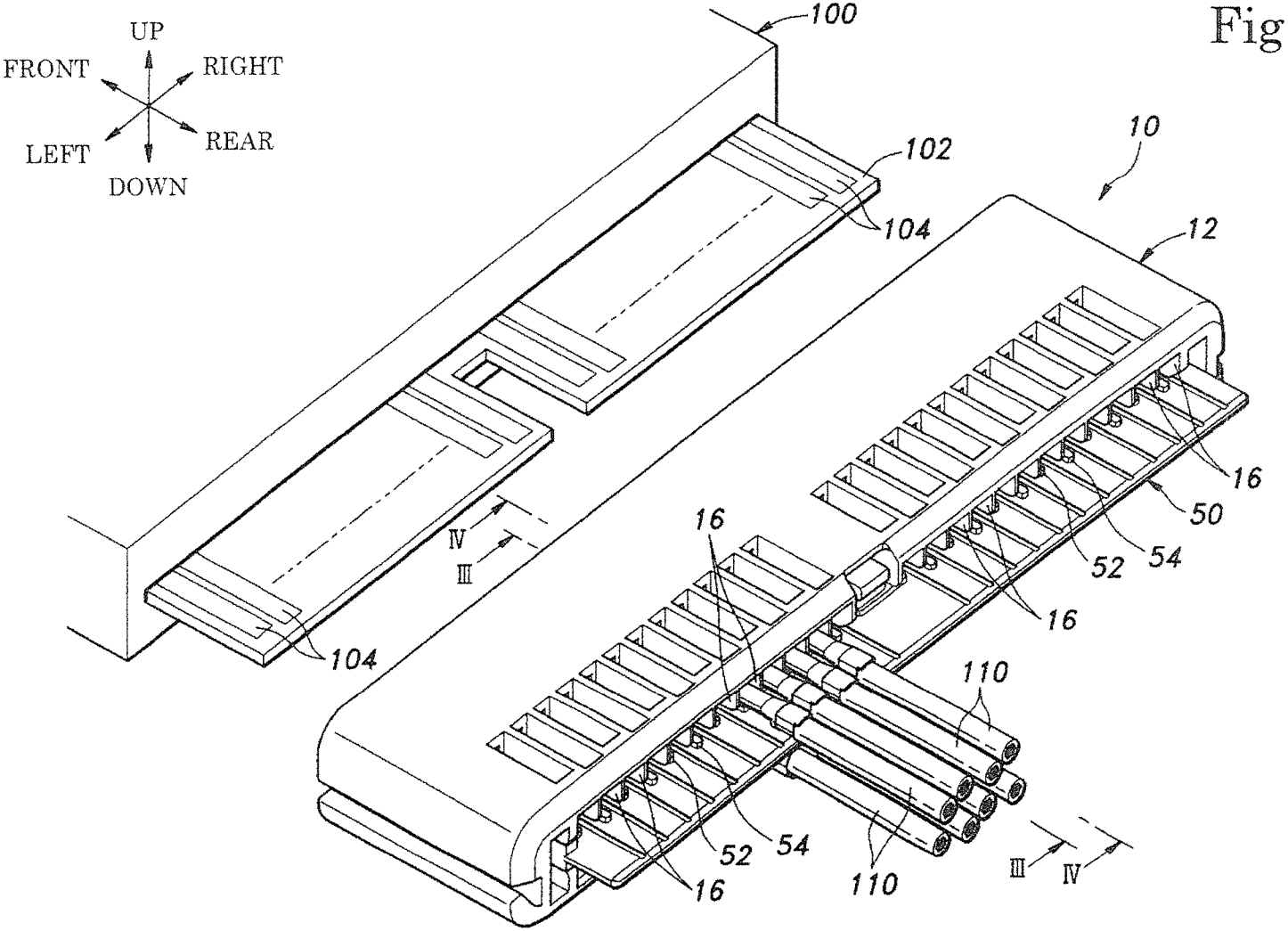
FIG. 1 is a perspective view illustrating an embodiment of a double-sided card edge connector in accordance with the present invention.

The double-sided card edge connector in accordance with the embodiment is overall designated by reference numeral 10. The double-sided card edge connector 10 is a connector for electric connection for a double-sided card edge 102. As illustrated in FIG. 1, the double-sided card edge 102 protrudes outward from an outer case 100 of electrical equipment such as a microcomputer and the like, and has a plurality of layer board terminals 104 formed on each of its top-surface and undersurface (not shown) as part of a double-sided print board, the board terminals 104 being arranged to be positioned at equal pitch in the left-right direction. In the embodiment, the 24 board terminals 104 are formed on each of the top-surface and undersurface of the double-sided card edge 102. Adjacent board terminals 104 of the board terminals 104 differ in terminal length from each other in relation to the offset arrangement of terminal members 20 which will be described later. Incidentally, varying the terminal length is not an absolute necessity.

As illustrated in FIG. 1 to FIG. 4, the double-sided card edge connector 10 has a connector housing 12 which is a resin molded product. The connector housing 12 is formed in a flat shape with a length in the left-right direction, and includes a receptacle compartment 14 into which the double-sided card edge 102 is inserted through a receptacle opening 14A formed in the front. In the connector housing 12, as illustrated in FIG. 1 to FIG. 4, a plurality of terminal mounting recesses 16, 24 terminal mounting recesses 16 in the embodiment, are formed on each of the upper and lower sides of the receptacle compartment 14 such that the upper and lower terminal mounting recesses 16 are on the opposite side of the receptacle compartment 14 from each other. The terminal mounting recesses 16 are spaced at equal pitch in the left-right direction on each side of the receptacle compartment 14. Terminal members 20 are mounted respectively in the terminal mounting recesses 16.

Figure 5:
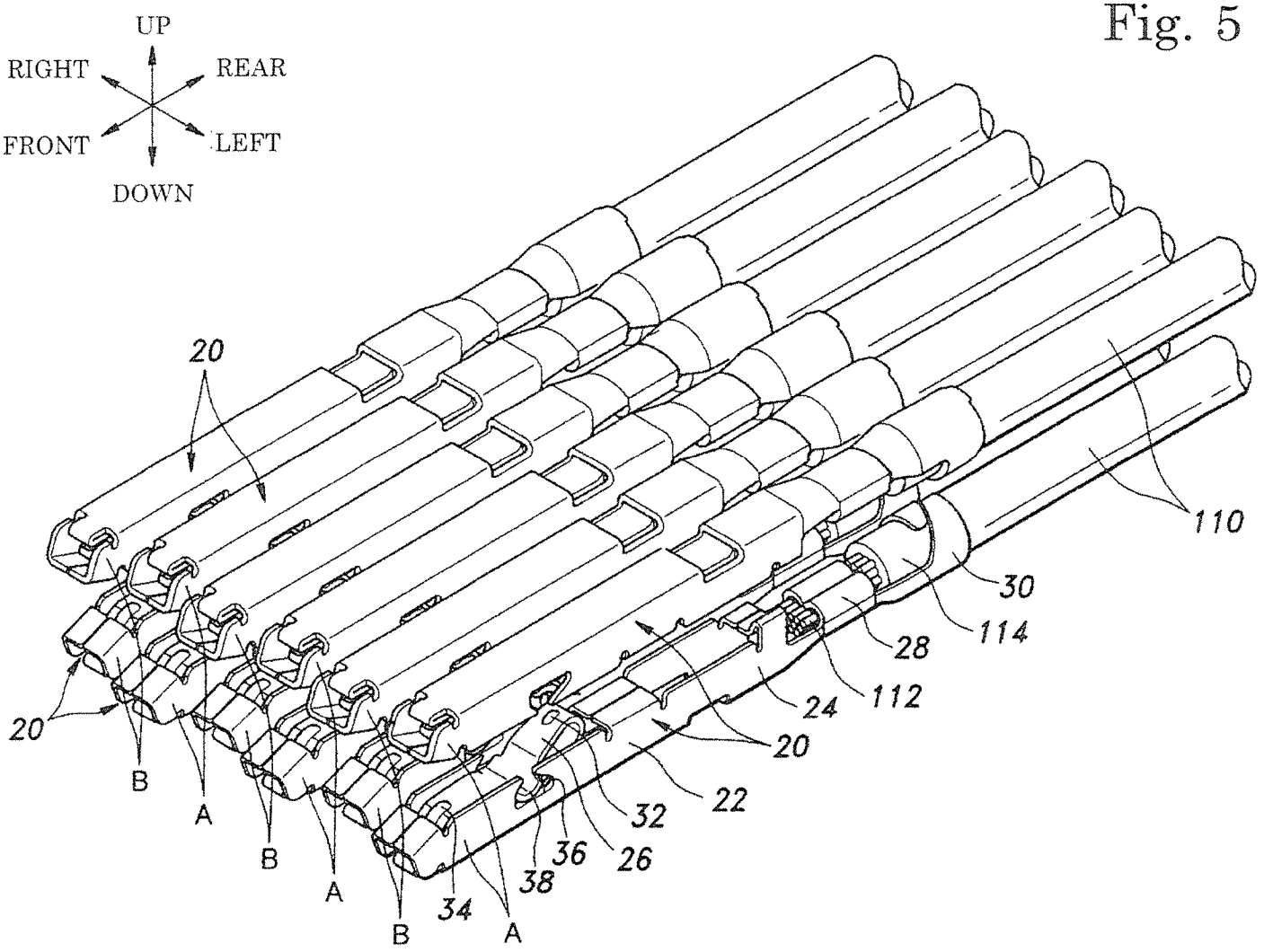
FIG. 5 is a perspective view illustrating an arrangement of terminal pairs in accordance with the embodiment.

Two upper and lower ones of the terminal members 20 facing each other across the receptacle compartment 14 are paired to form a terminal pair A or B (see FIG. 5). A plurality of the terminal pairs A and B is arranged in alternate order and spaced at equal pitch in the left-right direction. In the embodiment, the 24 terminal pairs (24 pairs) in total are properly arranged. As a result, the upper and lower terminal members 20 correspond respectively to the board terminals 104 formed both on the top-surface and undersurface of the double-sided card edge 102, in an individual manner.

Figure 7:
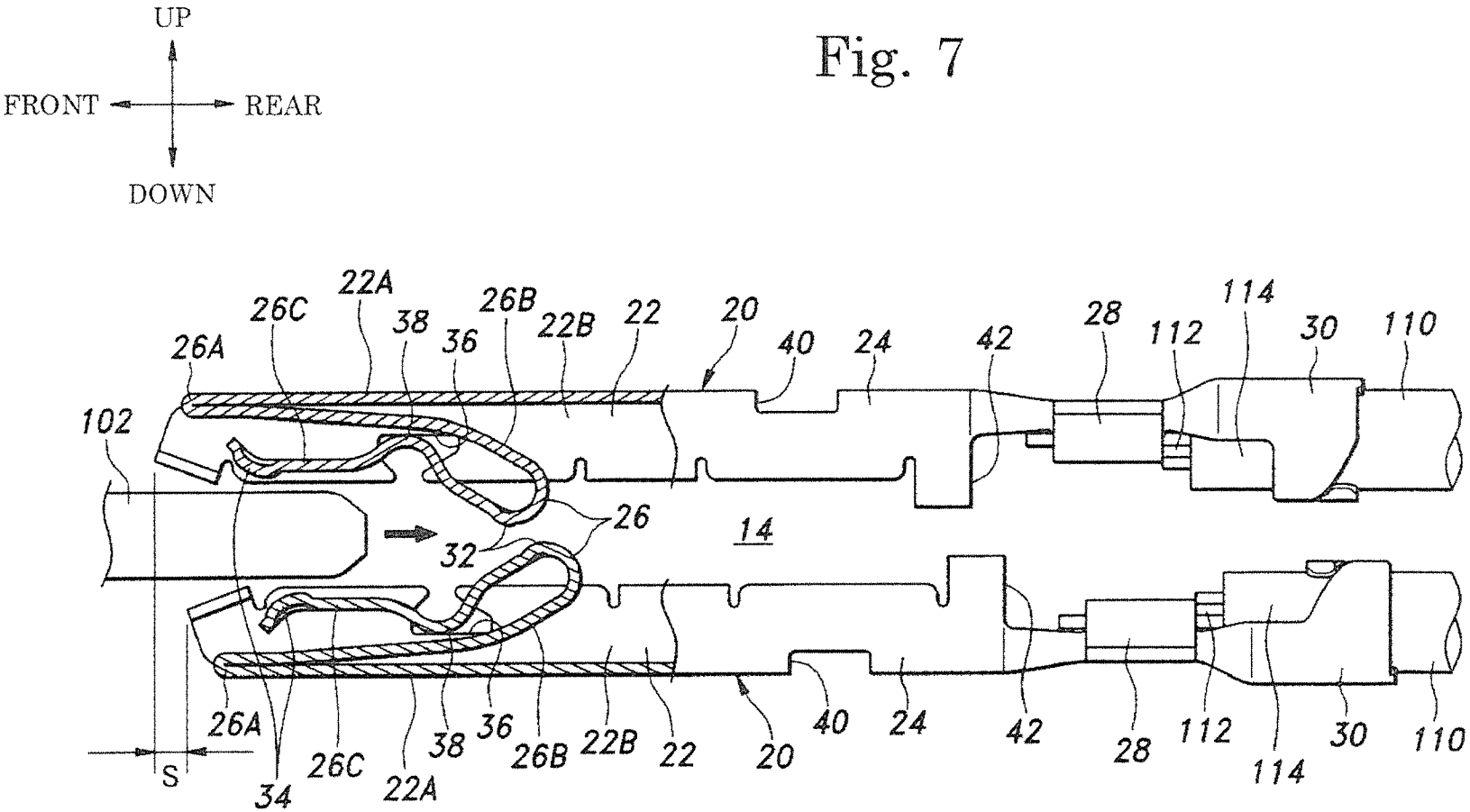
FIG. 7 is a side, partially cross-sectional view illustrating details of a terminal member of the double-sided card edge connector in accordance with the invention.

Although, as illustrated in FIG. 7, the upper and lower terminal members 20 are shown to be vertically flipped relative to each other, all of which are formed of press-formed products (components) of the same shape. The "pressed-formed products of the same shape" as used herein refer to pressed-formed products that are identical not only in shape but also in dimensions of any part.

Each of the terminal members 20 includes a terminal body 24 and a contact piece 26. The terminal body 24 has a groove-shaped cross-section portion 22 formed in the front. The contact piece 26 has a proximal end 26A coupled to a bottom 22A of the groove-shaped cross-section portion 22. The terminal body 24 has conductor barrel 28 and a sheath barrel 30 formed in the rear so that a cable conductor 112 and a sheathed portion 114 of each sheathed cable 110 are crimped respectively to the conductor barrel 28 and the sheath barrel 30.

The contact piece 26 also has a proximal-end piece portion 26B and a free-end piece portion 26C, in which the proximal-end piece portion 26B is formed by the contact piece 26 being folded backward, at the proximal end 26A as a turning point, from the front end of the bottom 22A of the groove-shaped cross-section portion 22, and the free-end piece portion 26C is formed by the contact piece 26 being further folded forward from the leading end of the proximal-end piece portion 26B. Such a contact piece 26 is entirely made up of a bent piece formed integrally with the bottom 22A, and has spring characteristics capable of effecting resilient deformation in the up and down directions.

A contacting portion 32 is formed at a turning point where the proximal-end piece portion 26B and the free-end piece portion 26C are connected to each other. The contacting portion 32 is located within the receptacle compartment 14 in a free state, and comes in contact with the top-surface or undersurface of the double-sided card edge 102 which has been inserted into the receptacle compartment 14. The "free state" as used herein refers to a state in which the contact piece 26 is not resiliently deformed by external forces.

The leading end of the free-end piece portion 26C is a free end at which a contact 34 is formed to establish conductive connection to the corresponding board terminal 104. The contact 34 is located away from the receptacle compartment 14 and within the groove-shaped cross-section portion 22 in the free state. Then, by inserting the double-sided card edge 102 into the receptacle compartment 14, the contacting portion 32 is pressed by the double-sided card edge 102 to cause resilient deformation in the contact piece 26. This resilient deformation moves the contact 34 into the receptacle compartment 14, so that the contact 34 is pressed against the board terminal 104 with a predetermined terminal contacting pressure.

Further, the contact piece 26 has an oxbow-shaped pivotable support 38 formed between the contacting portion 32 and the contact 34, i.e., at or around a midway point of the free-end piece portion 26C. The pivotable support 38 is engaged, in a swingable manner, with a recess (supporting portion) 36 formed in a side portion 22B of the groove-shaped cross-section portion 22. Engaging the pivotable support 38 with the recess 36 allows the free-end piece portion 26C to be pivotably supported to be swingable relative to the terminal body 24 about the pivotable support 38 approximately in the up and down directions.

An opening 40 is formed in the bottom 22A of the groove-shaped cross-section portion 22 to act as a locked portion with which a lance piece 18 of the connector housing 12 which will be described later is engaged. A rearward-facing vertical plane, retainer abutment 42 is formed at a rear end of the groove-shaped cross-section portion 22.

In the terminal member 20 described above, the contact 34 is prevented from being worn or damaged by contact with the double-sided card edge 102, because the contact 34 makes no sliding contact with the top-surface or undersurface of the double-sided card edge 102 until the contacting portion 32 is pressed by the double-sided card edge 102. Further, the contact 34 is avoided from being contaminated by impurities such as oil and/or the like in the assembling process. Thus, an electrical conduction failure may be prevented from being caused by the depositing of impurities to the contact 34, resulting in ensuring satisfactory conductive connection established between the contacting portion 32 and the board terminal 104 with a high degree of reliability.

Further, a lever is configured when the pivotable support 38 acts as a fulcrum, the contacting portion 32 acts as a point of effort and the contact 34 acts as a point of load. Upon pressing the contacting portion 32, under the lever operation, the operation of the contact 34 entering the receptacle compartment 14 is satisfactorily performed with repeatability.

Because all of the terminal members 20, including the upper and lower terminal members 20, are components identical in shape, each of the terminal members 20 has the opening 40 and the retainer abutment 42 formed in the same positions in the longitudinal direction (the same direction as the insertion direction of inserting the double-sided card edge 102 into the receptacle compartment 14=the front-rear direction) of the terminal member 20.

To mount each of the terminal members 20 to the corresponding terminal mounting recess 16, the terminal member 20 is inserted along the terminal mounting recess 16 from the rear of the connecter housing 12 until a leading end 24A of the terminal body 24 abuts on a front wall 12A of the terminal body 24.

The connector housing 12 has a plurality of integrally-molded lance pieces 18 and 19. The lance pieces 18, 19 have spring characteristics provided by cantilever pieces extending forward from both the rear upper side and the rear lower side of the connector housing 12, each cantilever piece being for each terminal mounting recess 16.

Each of the lance pieces 18 and 19 acts as a locking portion for the terminal member 20. When the terminal member 20 is inserted to a position in which the leading end 24A of the terminal body 24 abuts on the front wall 12A of the connector housing 12, a free end 18A, 19A of the lance piece 18, 19 is engaged with the opening 40 of the terminal member 20 in order to lock and fasten the terminal member 20 to the connector housing 12, so that the terminal member 20 is inhibited from moving in a rearward direction in which the terminal member 20 falls out of from the connector housing 12, and the positioning of the terminal member 20 in the connector housing 12 in the front-rear direction (the insertion direction of the double-sided card edge 102 being inserted into the receptacle compartment 14) is achieved.

A single plate-shaped rear retainer 50 inserted between the upper and lower terminal members 20 is secured to a rear portion of the connector housing 12. The rear retainer 50, which is a resin molded product, has upper and lower surfaces on which a plurality of protrusions 52 and 54 are integrally formed, each of the protrusions 52 and 54 having a vertical front face abutting on the retainer abutment 42 of each terminal member 20.

A front face of each protrusion 52, 54 abuts on the retainer abutment 42 of the corresponding upper or lower terminal member 20, thereby the rear retainer 50 inhibits the movement of the terminal member 20 in a rearward direction in which the terminal member 20 falls out of from the connector housing 12. Thus, the retainer 50 achieves, in conjunction with the lance piece 18, 19, the positioning of the terminal member 20 in the connector housing 12 in the front-rear direction (the insertion direction of the double-sided card edge 102 being inserted into the receptacle compartment 14).

Figure 2:
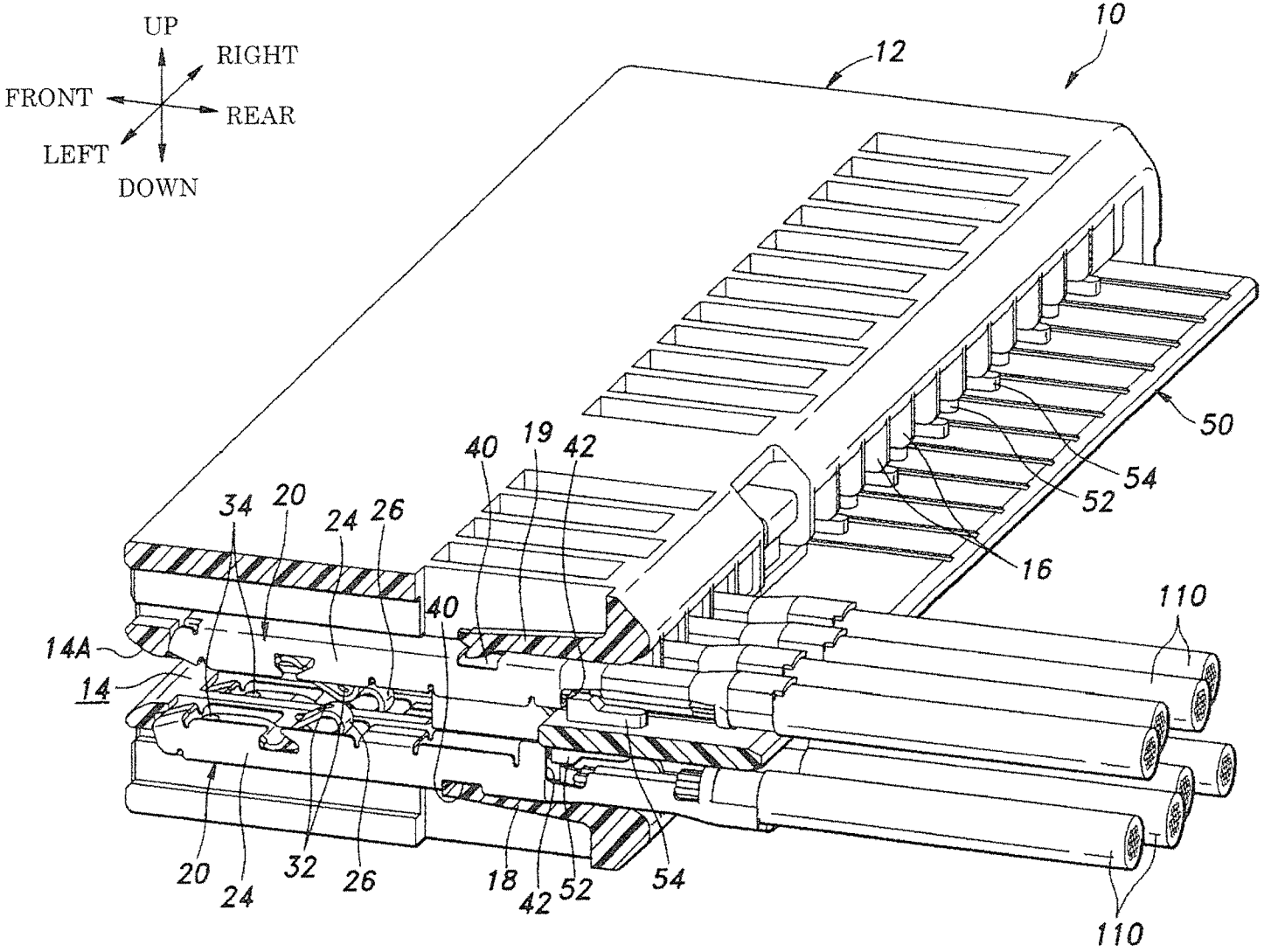
FIG. 2 is a perspective, partially cross-sectional view of a double-sided card edge connector in accordance with the embodiment.
Figure 3:
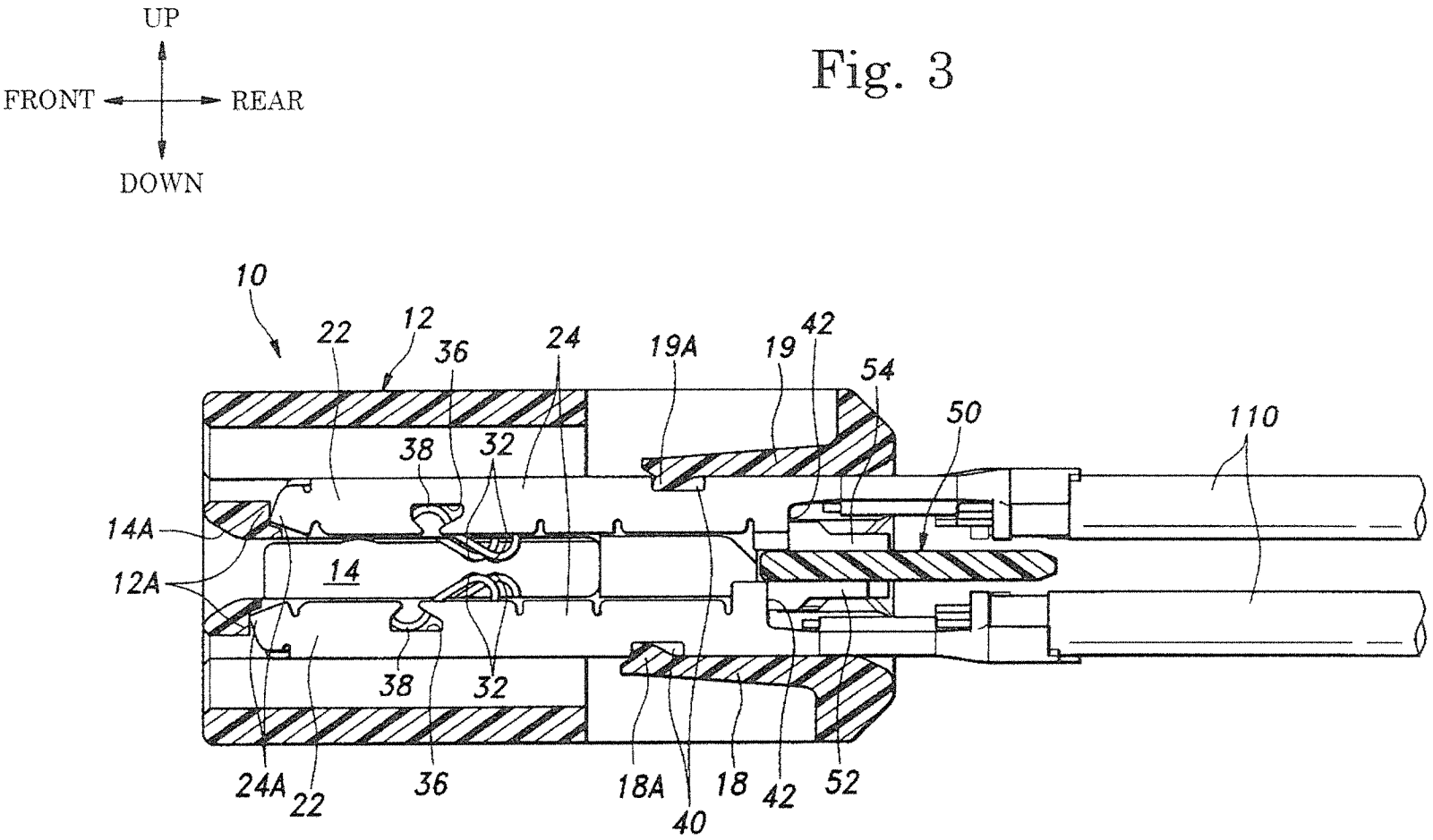
FIG. 3 is an enlarged cross-sectional view taken along III-III line of FIG. 1.
Figure 4:
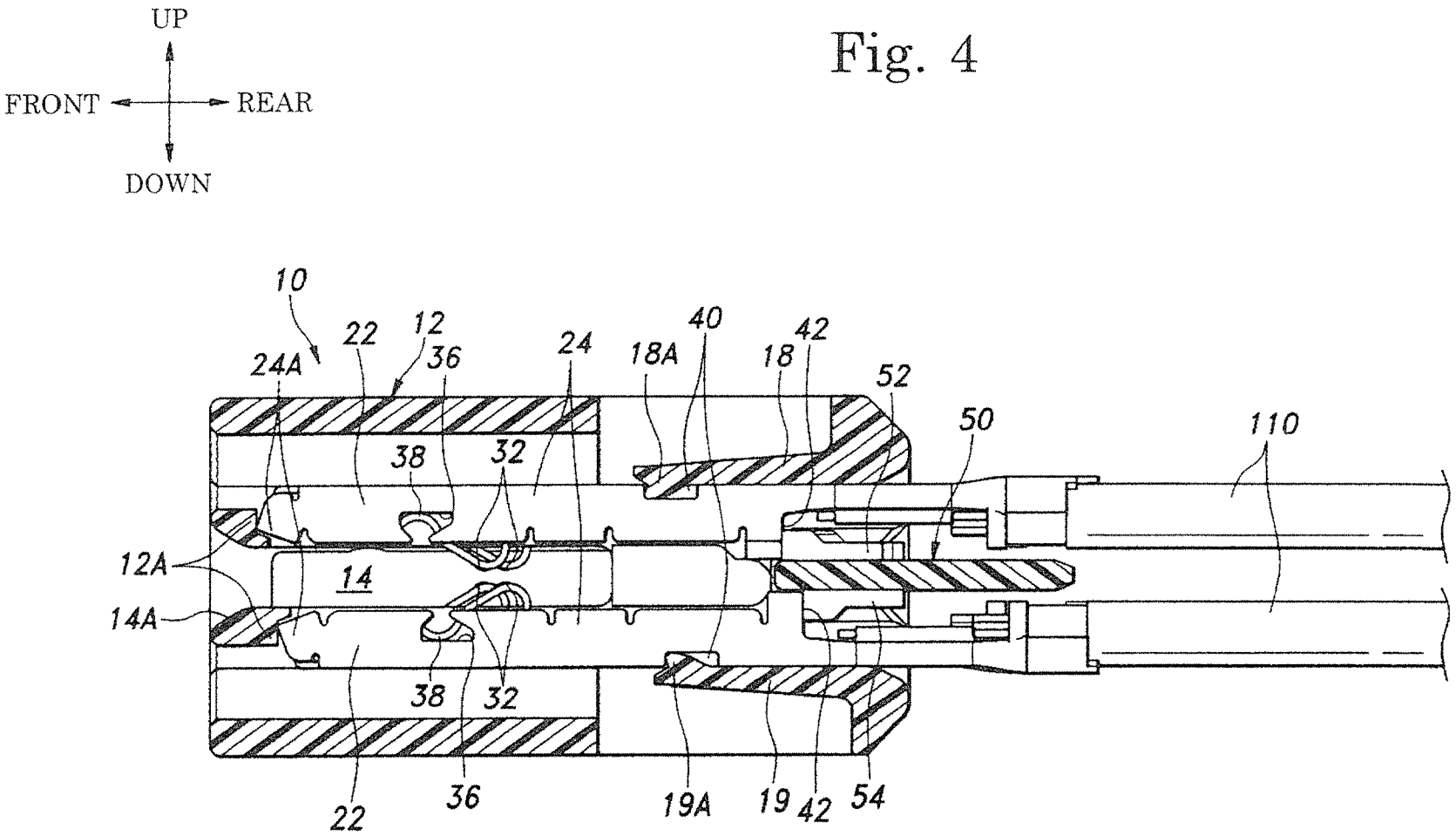
FIG. 4 is an enlarged cross-sectional view taken along IV-IV line of FIG. 1.

As illustrated in FIG. 2 to FIG. 4, the lance pieces 18 and 19 are offset in the direction of the double-sided card edge 102 being inserted into the receptacle compartment 14 (front-rear direction) and also the protrusions 52 and 54 are offset in the front-rear direction).

In this manner, the upper and lower terminal members 20 facing each other are secured to the connector housing 12 while being offset for each terminal pair A, B by a predetermined offset S (see FIG. 7) in the insertion direction of the double-sided card edge 102 being inserted into the receptacle compartment 14. By this offset arrangement, the contacting portion 32 of the upper terminal member 20 and the contacting portion 32 of the lower terminal member 20 are offset from each other in the front-rear direction, so that the upper contacting portion 32 and the lower contacting portion 32 are kept contact from each other even if a high amount of protrusion of the contacting portions 32 protruding into the receptacle compartment 14 is set. Thus, the amount of protrusion of the contacting portion 32 protruding into the receptacle compartment 14 can be increased as compared with the upper and lower contacting portions 32 are directly opposite each other.

This increases the amount of resilient deformation of the contact piece 26 when the double-sided card edge 102 is inserted into the receptacle compartment 14. In step with this, the terminal contacting pressure of the contact 34 to the board terminal 104 increases.

In such offset specifications, because all of the mutually facing terminal members 20 are formed of components identical in shape, achieving the offset arrangement involves no increase of the number of kinds of necessary components including the terminal members 20, thereby requiring no extra time and effort for parts management. Further, because the same component is used for the upper and lower terminal members 20, the upper and lower terminal member 20 may not be incorrectly assembled to the connector housing 12.

Figure 6:
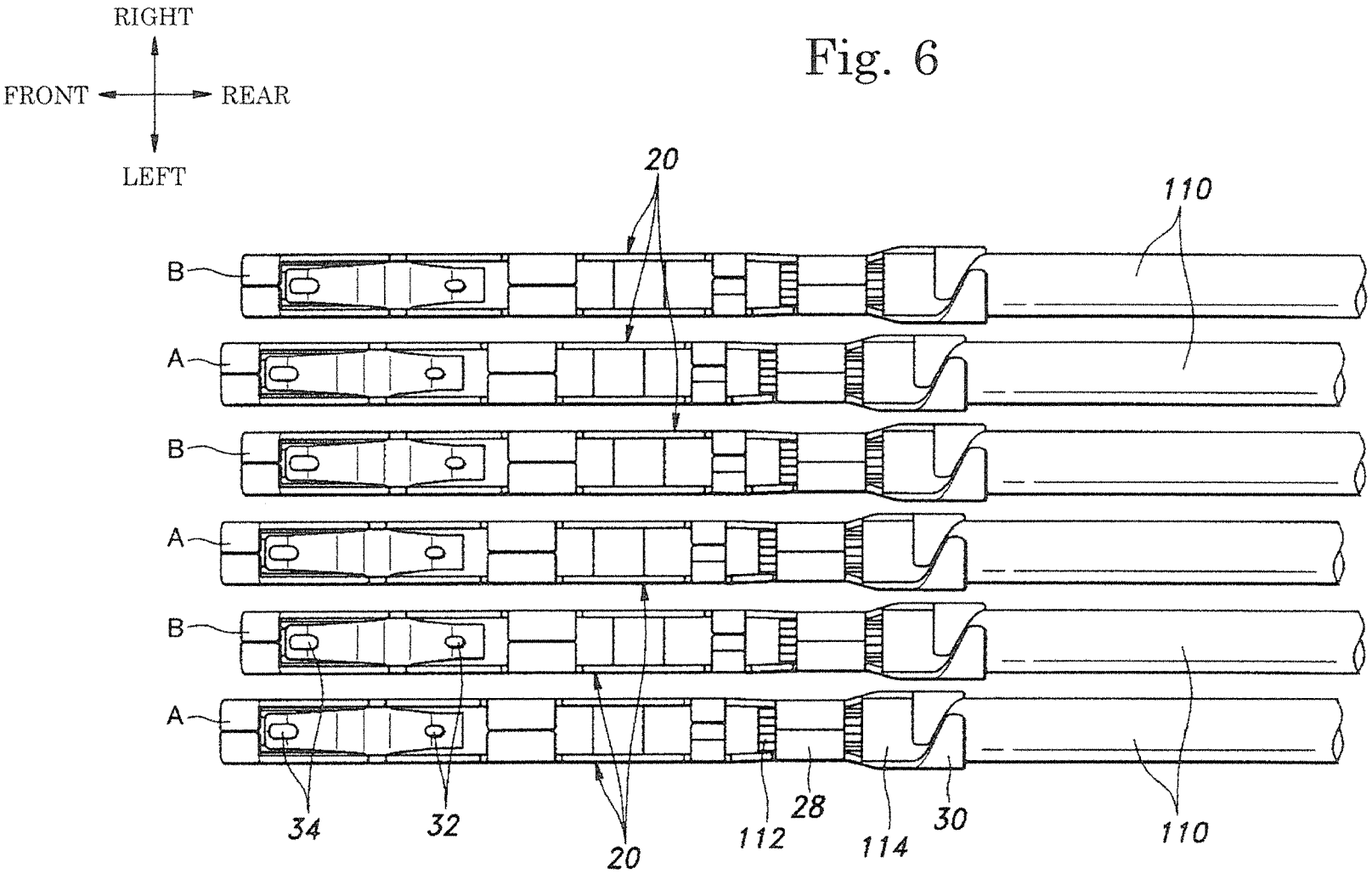
FIG. 6 is a top view illustrating the arrangement of terminal pairs in accordance with the embodiment.

In the terminal pair A, the lower terminal member 20 is offset forward of the upper terminal member 20, while in the terminal pair B, the lower terminal member 20 is offset rearward of the upper terminal member 20. Accordingly, the same number of the terminal pairs A and the terminal pairs B (the 12 terminal pairs A and the 12 terminal pairs B) are arranged in alternate order (staggered arrangement). Incidentally, FIG. 6 illustrates the arranged positions of the lower terminal members 20.

In this manner, because the upper and lower contacting portions 32 in each of the terminal pairs A and B are offset from each other in the front-rear direction, when the top and under surfaces of the double-sided card edge 102 come into contact with the upper and lower contacting portions 32, turning moments around a horizontal axis in the left-right direction acting on the double-sided card edge 102 are compensated. Thus, when the double-sided card edge 102 is inserted into the receptacle compartment 14, the double-sided card edge 102 can be inserted horizontally without tilting upward/downward.

Figure 8:
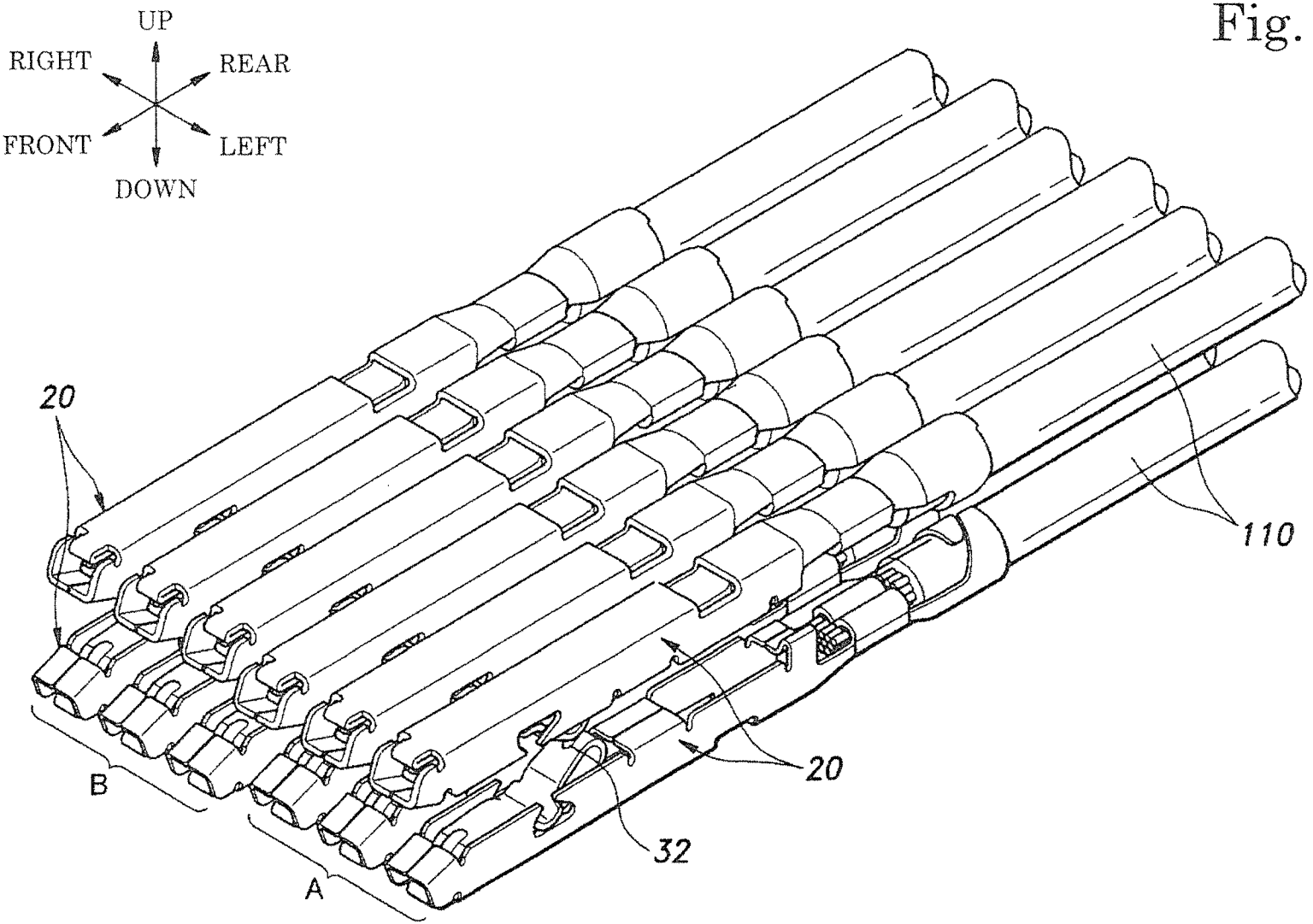
FIG. 8 is a perspective view illustrating an arrangement of terminal pairs in accordance with another embodiment.
Figure 9:
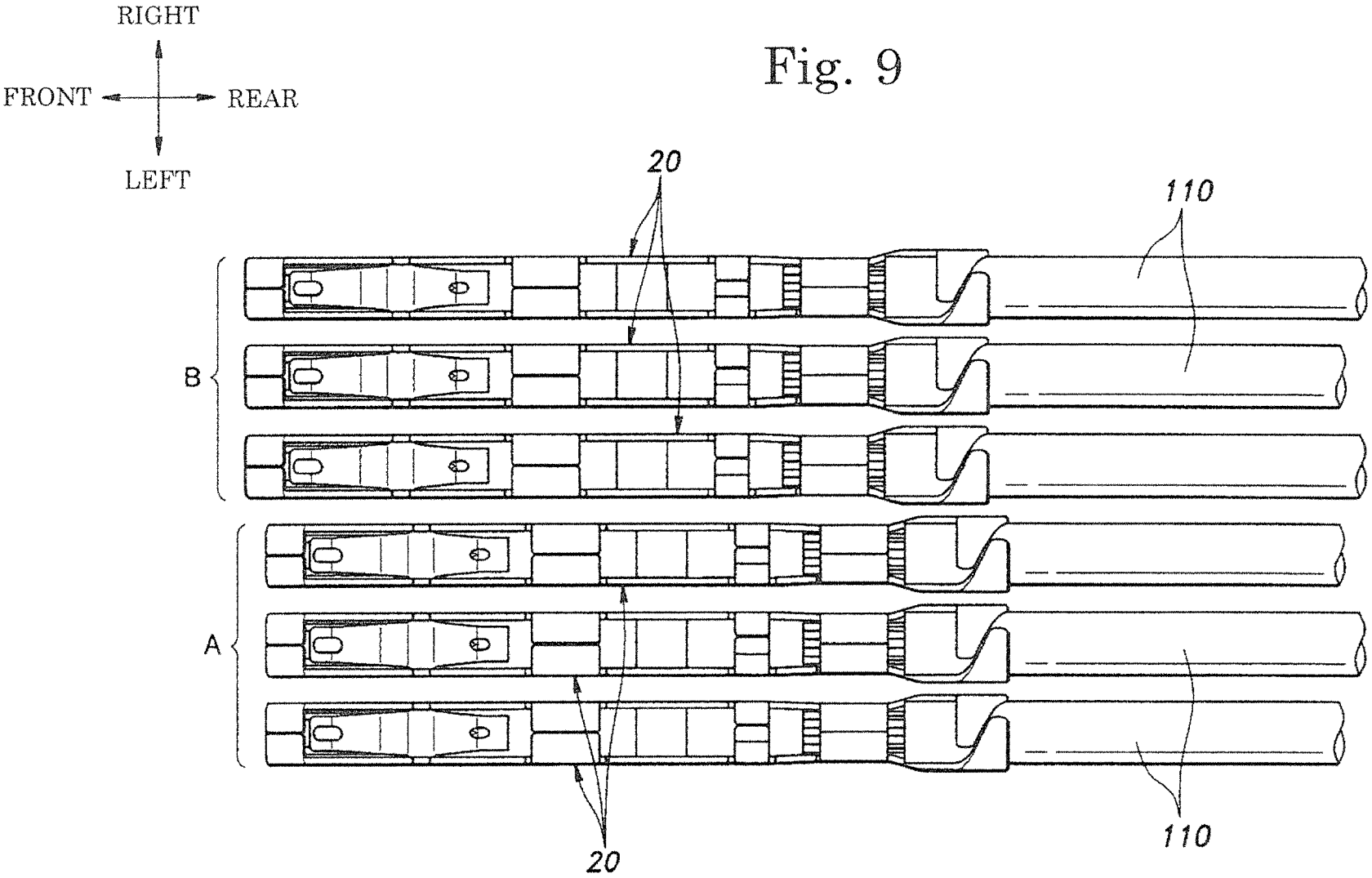
FIG. 9 is a top view illustrating an arrangement of terminal pairs in accordance with another embodiment.

As long as the total of the numbers of terminal pairs A and terminal pairs B is an even number and the terminal pairs A and the terminal pairs B are identical in number, employing the staggered arrangement is not necessarily required. As illustrated in FIGS. 8 and 9, the terminal pairs A and the terminal pairs B may be arranged in groups.

Figure 10:
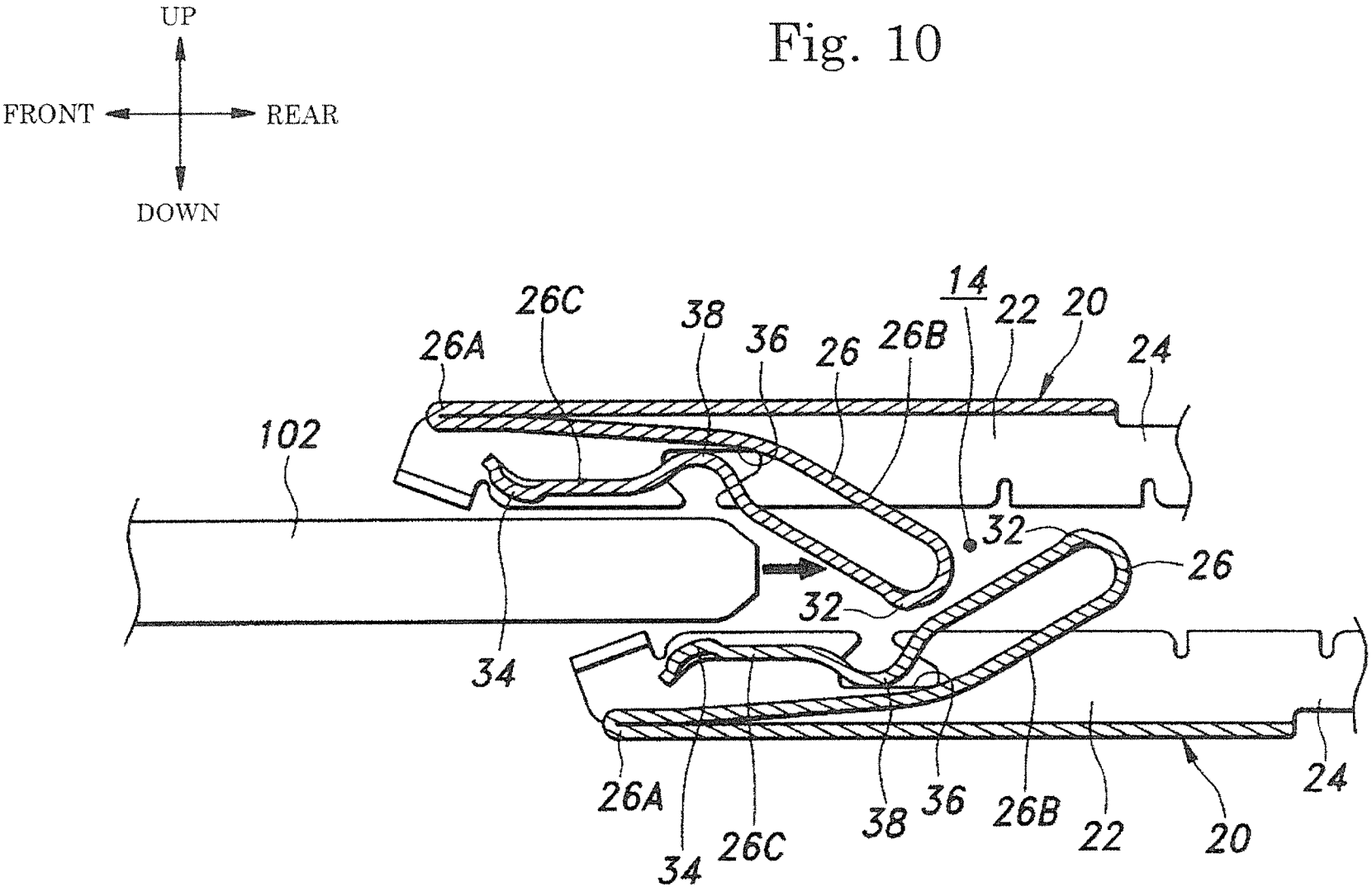
FIG. 10 is a partially cross-sectional view illustrating details of a terminal member in accordance with another embodiment.

As illustrated in FIG. 10, because of the offset, the contact pieces 26 of the upper and lower terminal members 20 in each terminal pair A or B may include portions overlapping each other when viewed in plane of projection intersecting at right angles to the insertion direction. In this case, without making contact between the upper contacting portion 32 and the lower contacting portion 32, an increase of the amount of protrusion of the contacting portion 32 protruding in the receptacle compartment 14 can be enabled. In this case, all of the terminal members 20 in the terminal pair A or the terminal pair B may be formed of components identical in shape.

Figure 11:
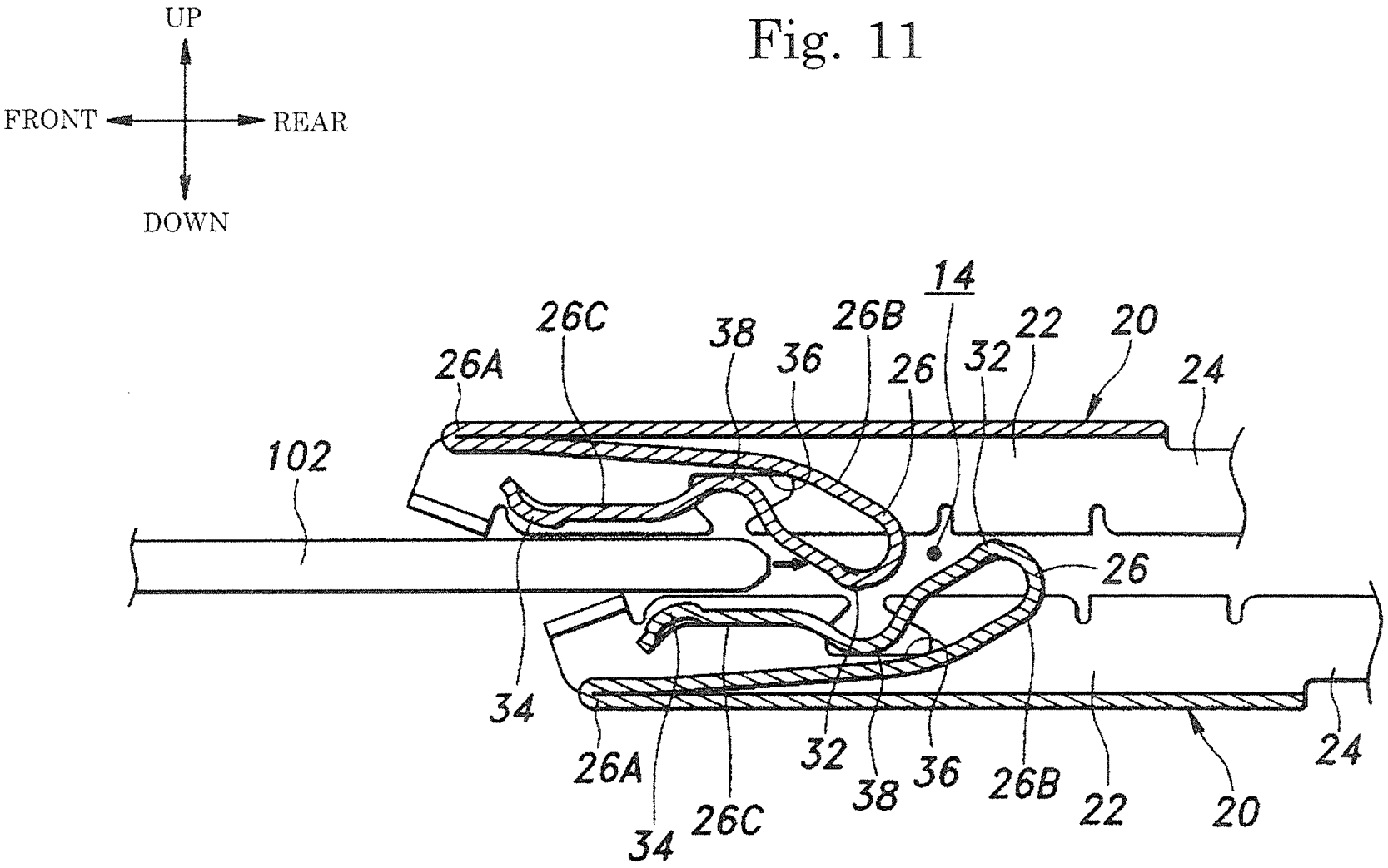
FIG. 11 is a partially cross-sectional view illustrating details of a terminal member in accordance with another embodiment.

This causes a further increase of the amount of resilient deformation of the contact piece 26 when the double-sided card edge 102 is inserted into the receptacle compartment 14. In step with this, the terminal contacting pressure of the contact 34 to the board terminal 104 further increases. Further, as illustrated in FIG. 11, the card edge connector 10 is compatible with a double-sided card edge 102 with a thin thickness.

Although the present invention have been described and illustrated with reference to a preferred embodiment, as those skilled in the art will easily understand, the present invention is not limited to such an embodiment and various changes may be made as appropriate without departing from the sprit and scope of the present invention.

Figure 12:
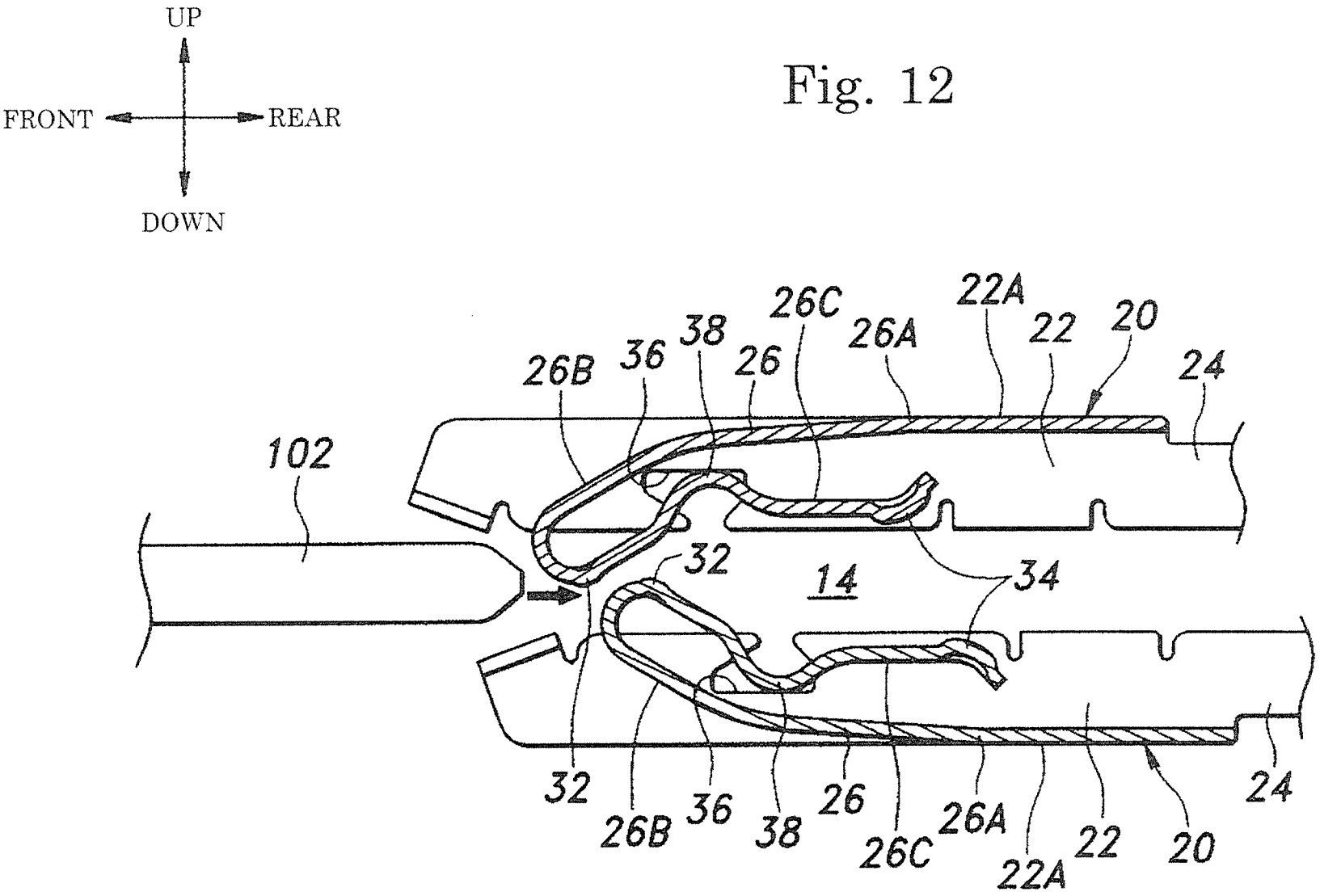
FIG. 12 is a partially cross-sectional view illustrating details of a terminal member in accordance with another embodiment.
Figure 13:
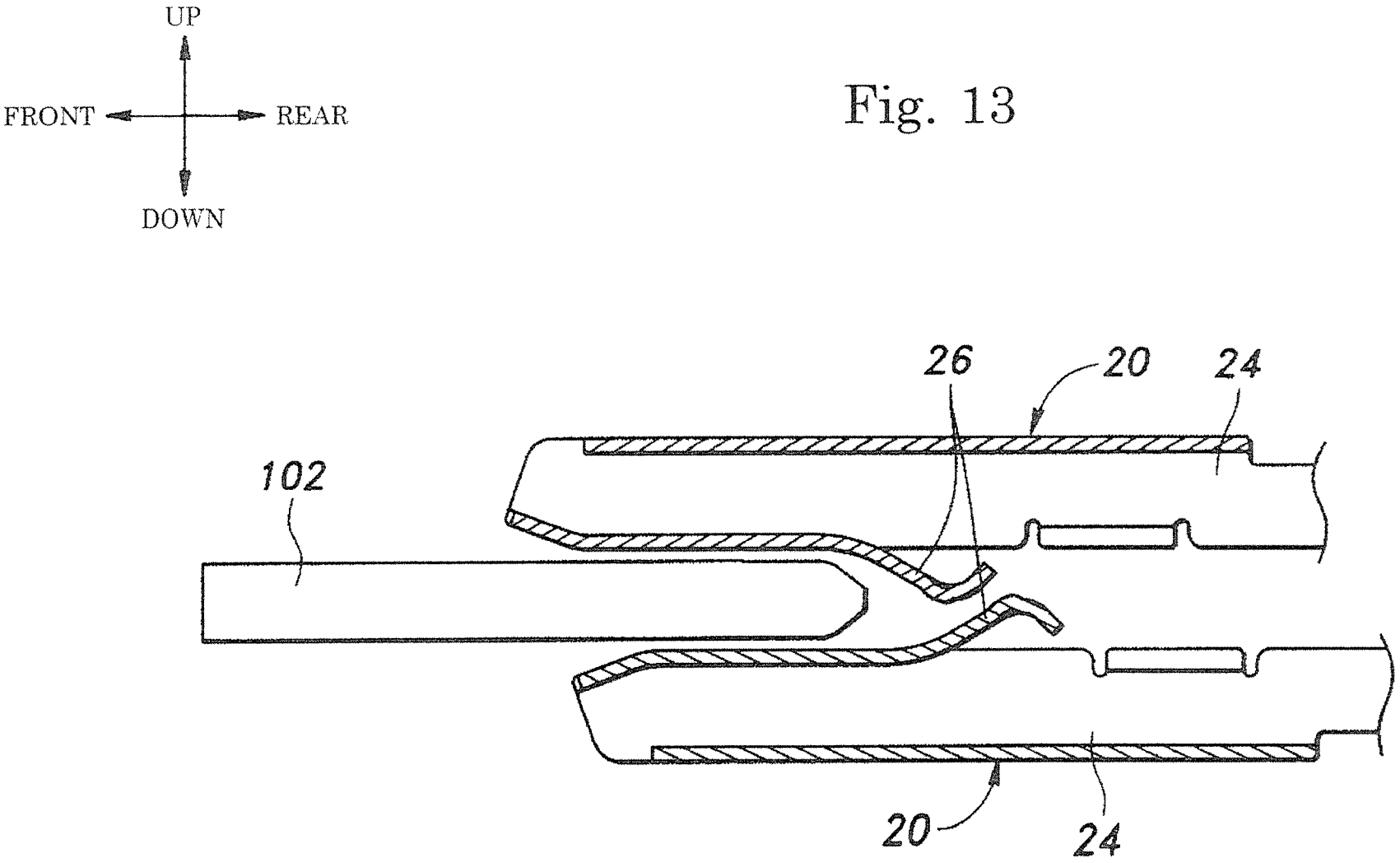
FIG. 13 is a partially cross-sectional view illustrating details of a terminal member in accordance with another embodiment.
Figure 14:
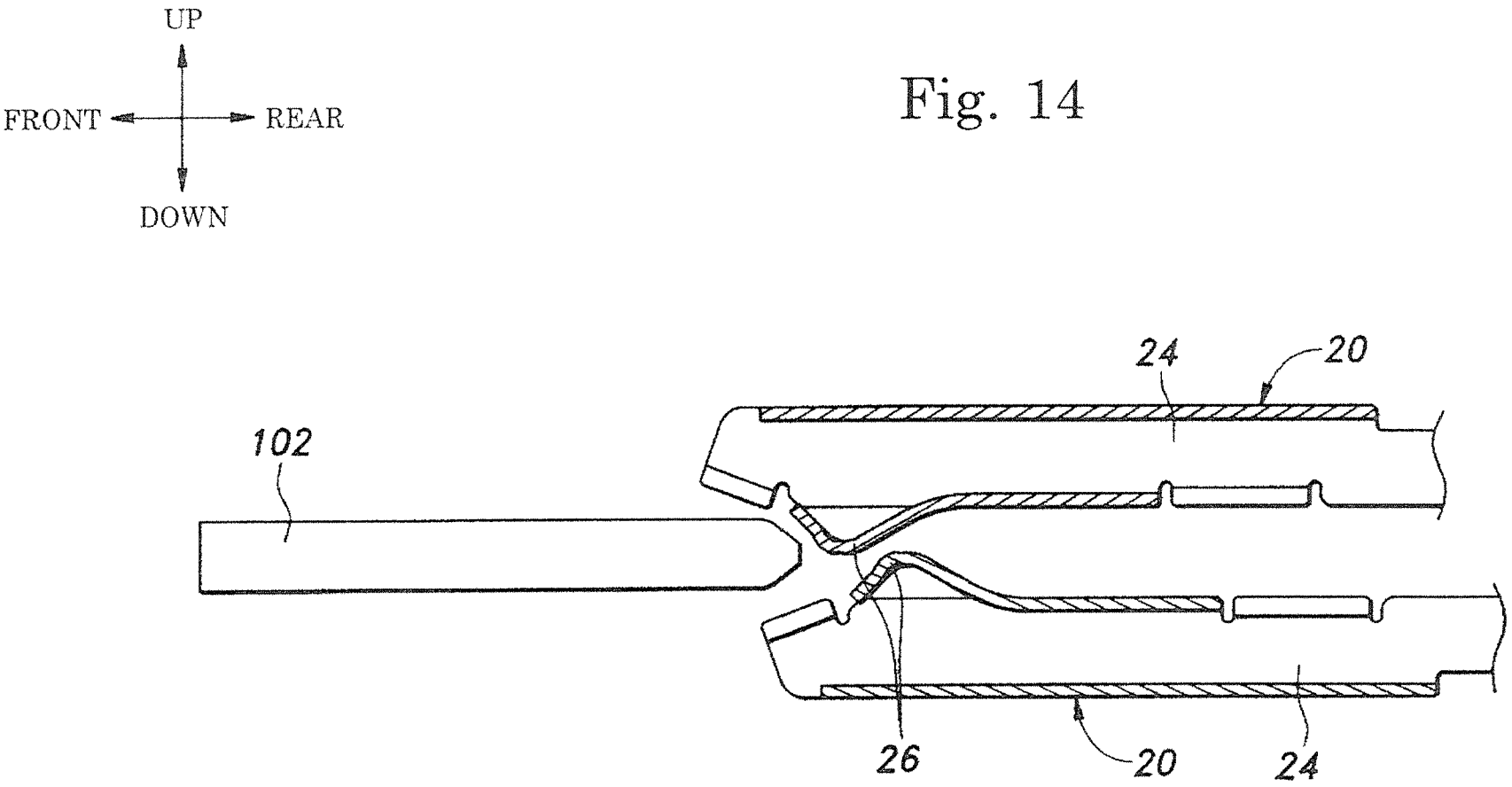
FIG. 14 is a partially cross-sectional view illustrating details of a terminal member in accordance with another embodiment.
Figure 15:
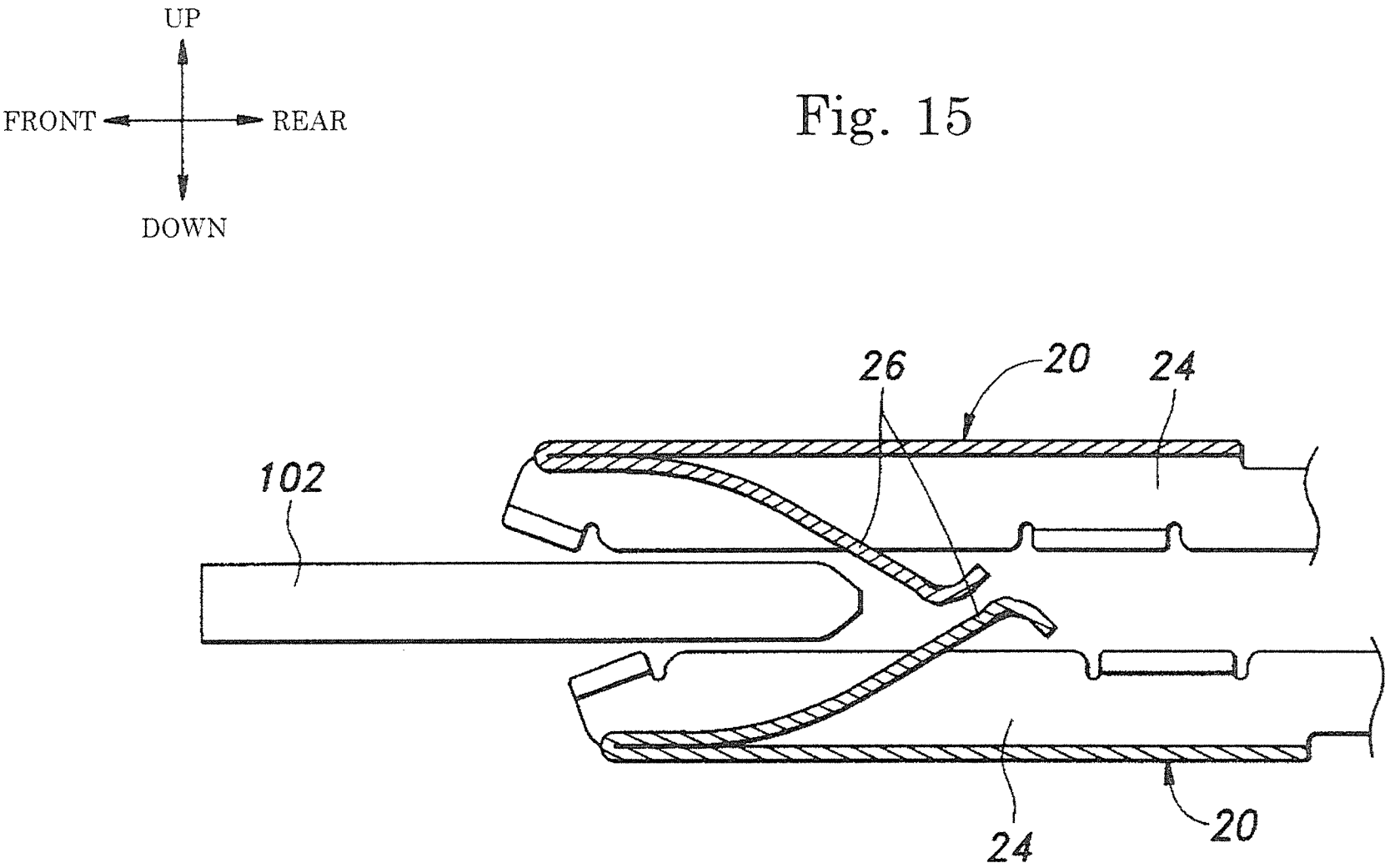
FIG. 15 is a partially cross-sectional view illustrating details of a terminal member in accordance with another embodiment.
Figure 16:
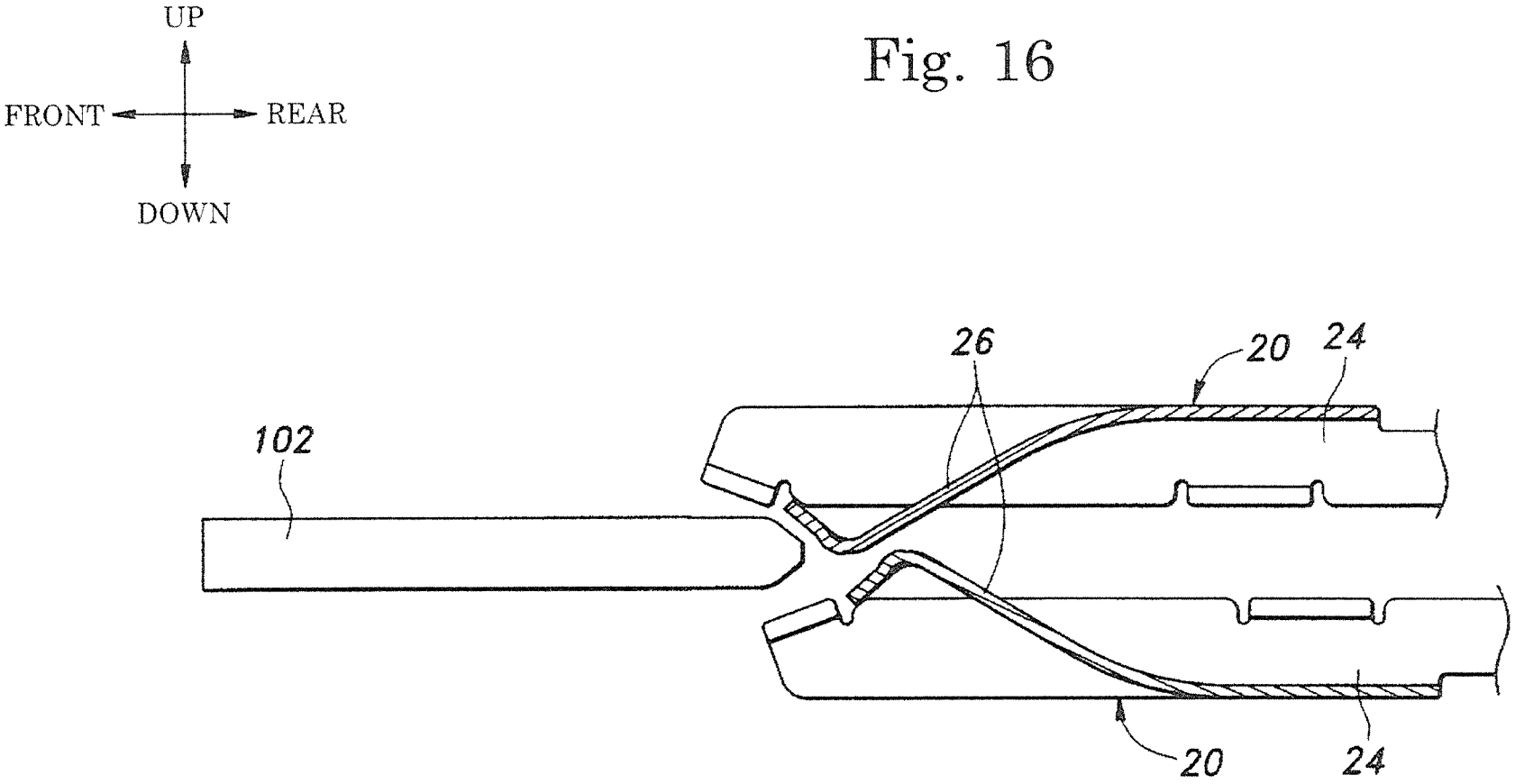
FIG. 16 s a partially cross-sectional view illustrating details of a terminal member in accordance with another embodiment.
Figure 17:
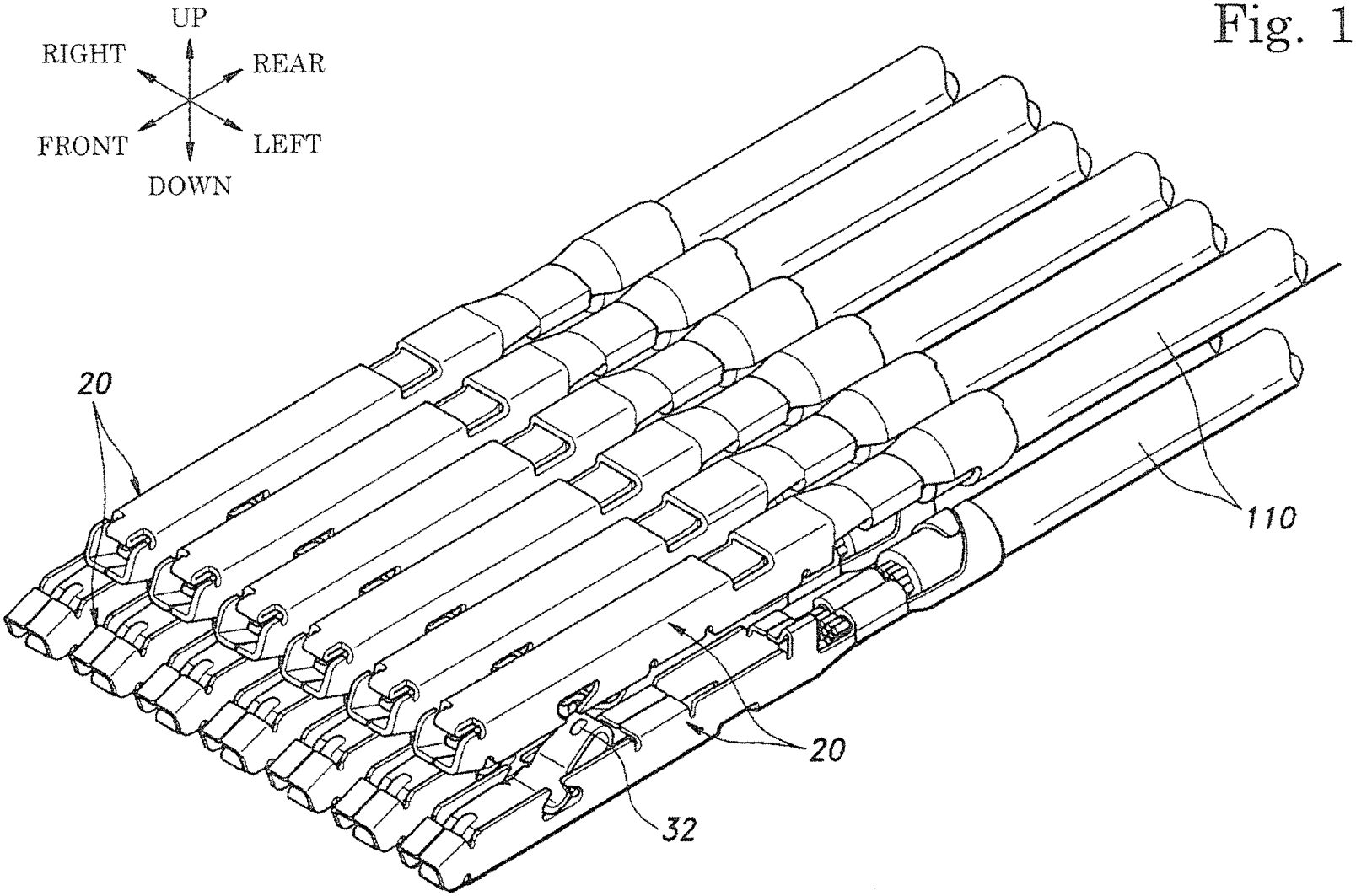
FIG. 17 is a perspective view illustrating an arrangement of terminal pairs in accordance with another embodiment.

The structure of the contact piece 26 of the terminal member 20 is not limited to that described and illustrated in the above embodiment. As illustrated in FIG. 12, the extension direction of the contact piece 26 with respect to the terminal body 24 may be reversed in the front-rear direction. The pivotable support 38 may be omitted. Further, the structure of the contact piece 26 of the terminal member 20 may use a simple cantilever piece as illustrated in FIGS. 13 to 16. Further, a plurality of the terminal pairs of upper and lower terminal members 20 are not necessarily arranged in staggered form and the like. As illustrated in FIG. 17, all of the lower terminal members 20 may be offset uniformly forward of the upper terminal members 20. The number of terminal pairs is not limited to an even number and may be an odd number.

In addition, all the components shown in the above embodiment is not necessarily required, and may be sifted through as appropriate without departing from the sprit and scope of the present invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A double-sided card edge connector, comprising:

a connector housing including a receptacle compartment into which a double-sided card edge is inserted; and at least two terminal members including contact pieces having spring characteristics, the terminal members being attached to the connector housing, wherein the terminal members are arranged to face each other with the contact pieces being positioned on both sides of the receptacle compartment, the contact pieces include contacting portions making contact with the double-sided card edge within the receptacle compartment, the terminal members facing each other are formed of components identical in shape, the terminal members facing each other are secured to the connector housing while being offset in an insertion direction of the double-sided card edge inserted into the receptacle compartment.

2. The double-sided card edge connector according to claim 1, wherein the terminal members facing each other have locked portions engaged with the connector housing, while the connector housing has locking portions with which the locked portions of the terminal members are engaged to lock the terminal members, and the locking portions provided for the terminal members facing each other are formed to be offset in the insertion direction of the double-sided card edge.

3. The double-sided card edge connector according to claim 1, wherein the contact pieces of the terminal members facing each other include portions overlapping each other when viewed in plane of projection intersecting at right angles to the insertion direction.

4. The double-sided card edge connector according to claim 1, wherein the terminal members facing each other form a terminal pair, the terminal pair is provided in plural, a plurality of the terminal pairs are properly arranged and spaced at a predetermined pitch, and all of the terminal members are formed of components identical in shape.

5. The double-sided card edge connector according to claim 1, wherein the terminal pairs are provided in even numbers, and the even numbers of the terminal pairs include terminal pairs in each of which one of the terminal members is offset forward of the other terminal member in the insertion direction, and terminal pairs in each of which one of the terminal members is offset rearward of the other terminal member in the insertion direction, and the former terminal pairs and the latter terminal pairs are identical in number.

6. The double-sided card edge connector according to claim 1, wherein, in a plurality of the terminal pairs, the terminal pairs in each of which one of the terminal members is offset forward of the other terminal member in the insertion direction, and the terminal pairs in each of which one of the terminal members is offset rearward of the other terminal member in the insertion direction, are arranged in alternate order.

7. The double-sided card edge connector according to claim 1, wherein, in a plurality of the terminal pairs, the terminal pairs in each of which one of the terminal members is offset forward of the other terminal member in the insertion direction, and the terminal pairs in each of which one of the terminal members is offset rearward of the other terminal member in the insertion direction, form a plurality of clusters and are arranged.

8. The double-sided card edge connector according to claim 1, wherein each of the terminal members includes a terminal body having a groove-shaped cross-section portion, each of the contact pieces includes a proximal end which is coupled to the terminal body, and a free end which is located within the groove-shaped cross-section portion to be located in a position away from the receptacle compartment in a free state, the contact piece has the contacting portion between the proximal end and the free end, the contacting portion being located within the receptacle compartment in the free state, the free end forms an electric contact for a board terminal provided on the double-sided card edge, and upon insertion of the double-sided card edge into the receptacle compartment, when the contacting portion is pressed by the double-sided card edge, the electric contact undergoes displacement to enter the receptacle compartment to be pressed against the board terminal.

9. The double-sided card edge connector according to claim 8, wherein the contact piece has a pivotable support provided between the contacting portion and the electric contact and pivotably supported by a supporting portion provided in the terminal body.

* * * * *